US006983966B2

(12) United States Patent
Azrikam

(10) Patent No.: US 6,983,966 B2
(45) Date of Patent: Jan. 10, 2006

(54) ANIMAL WASTE SCOOPER

(76) Inventor: Hormiz Azrikam, 4918 Kirk St., Skokie, IL (US) 60077

( * ) Notice: Subject to any disclaimer, the term of this patent is extended or adjusted under 35 U.S.C. 154(b) by 0 days.

(21) Appl. No.: 10/680,206

(22) Filed: Oct. 8, 2003

(65) Prior Publication Data

US 2004/0066049 A1 Apr. 8, 2004

Related U.S. Application Data

(60) Provisional application No. 60/416,532, filed on Oct. 8, 2002.

(51) Int. Cl.
*A01K 29/00* (2006.01)
*E01H 1/12* (2006.01)

(52) U.S. Cl. ..... 294/1.4; 294/115

(58) Field of Classification Search ..... 294/1.3, 294/1.4, 1.5, 19.1, 50.8, 55, 115; 15/104.8, 15/257.1, 257.6
See application file for complete search history.

(56) References Cited

U.S. PATENT DOCUMENTS

| | | | | | |
|---|---|---|---|---|---|
| 2,028,680 | A | * | 1/1936 | Mayeda et al. | 294/115 |
| 3,446,525 | A | * | 5/1969 | Jones | 294/1.4 |
| 3,738,697 | A | * | 6/1973 | Kahan | 294/1.4 |
| 3,929,363 | A | * | 12/1975 | Kahan | 294/1.4 |
| 4,179,145 | A | | 12/1979 | Shinsako | 294/1.4 |
| 4,194,777 | A | * | 3/1980 | Carns | 294/1.4 |
| 4,225,174 | A | * | 9/1980 | Hennessy et al. | 294/1.4 |
| 4,248,468 | A | * | 2/1981 | Hastings | 294/1.4 |
| 4,951,987 | A | * | 8/1990 | Lebeau | 294/1.4 |
| 4,958,871 | A | * | 9/1990 | Hemans | 294/1.4 |
| 5,380,054 | A | | 1/1995 | Galvis | 294/1.4 |
| 5,503,442 | A | | 4/1996 | Lee | 294/1.4 |
| 5,601,321 | A | * | 2/1997 | Simon | 294/1.4 |
| 6,039,370 | A | * | 3/2000 | Dooley et al. | 294/1.5 |
| 6,142,543 | A | * | 11/2000 | Friberg | 294/1.4 |
| 6,305,322 | B1 | * | 10/2001 | Patel | 294/1.4 |

* cited by examiner

*Primary Examiner*—Eileen D. Lillis
*Assistant Examiner*—Paul T. Chin

(57) ABSTRACT

A hand-operated sanitary grasping device for grasping an object such as animal feces includes a control assembly, and extension structure, a support structure, which includes a pair of bag clips, a linkage assembly, a pair of scooped-shaped opposed jaws, and a pair springs. A plastic bag is placed over the jaws and attached to the bag clips on the support structure. The control assembly operates the jaws via the linkage assembly and has a latch to lock the jaws open before installing the inverted bag. The bag and jaws are placed around the object and the latch opened, allowing the jaws to grasp the object within the bag. The bag is then detached from the clips, allowing the bag to be pulled down over the jaws. The jaws may then be opened for removal of the bagged object.

12 Claims, 6 Drawing Sheets

ANIMAL WASTE SCOOPER

CROSS-REFERENCE TO RELATED APPLICATION

This application claims the benefit of U.S. Provisional Patent Application Ser. No. 60/416,532, filed Oct. 8, 2002.

BACKGROUND OF THE INVENTION

1. Field of the Invention

The present invention relates generally to hand-operated, pole mounted grasping devices and more particularly to an animal waste scooper for sanitary handling of animal droppings from pet dogs, cats, and the like, of the type commonly referred to as a pooper scooper.

2. Description of Related Art

Devices for picking up animal feces are well known. These devices usually have two opposing jaws, pivotally mounted at the bottom of a pole. The top end of the pole usually has a handle having a lever, trigger, button, or other device for actuating the jaws. With such a device, people may retrieve trash or animal feces from the ground without bending or reaching excessively, and further, may do so without coming into contact with the items to be picked up. However, the practical usefulness and reliability of these devices varies greatly.

One of the most appealing reasons for using such a grasping device is that the user's hands remain clean when picking up animal waste. However, typically the jaws of the device do not stay clean. The jaws are often unprotected and in direct contact with the waste material. The device will quickly become unwelcome in the user's home, due to the contamination. Thus, the device will be left outdoors and subject to the elements. This rapidly ages the device and leads to early failure or breakage. Alternatively, the user must take the time to clean the device, a chore that typically must be done by hand, preferably using rubber gloves to avoid soiling one's hands.

A few of the devices available today make use of covers for the grasping jaws, usually with plastic bags. However, there are no bag retention clips on those devices. The bags are loosely wrapped around the jaws with no regard for retention. The devices have no mechanical means for averting the external influences of wind, gravity, etc., in order to remain in place unassisted. In addition, where the device's jaws close automatically, the user must fight the tendency of the jaws to close while simultaneously attempting to place a plastic bag over the jaws.

A variation on that theme is jaws that are open when the machine is at rest. The jaws close when the device is actuated. Such a device requires the user to keep a tight grasp of the trigger or handle to keep from dropping the jaws' contents.

Various devices have been proposed for solving these problems.

U.S. Pat. No. 4,179,145, issued to Joe Shinsako in December 1979, describes a sanitary dog litter bagger that uses bags over a pair of jaws. The bags are not secured to the jaws. Actuation is by rotating the handle, requiring two hands.

U.S. Pat. No. 5,380,054, issued to Misael Galvis in January 1995, describes a handheld device for picking up objects. The device may be operated with one hand, but is not intended for use with bags.

U.S. Pat. No. 5,503,442, issued to Ke-Chiang Lee in April 1996, describes a pick-up device for picking up animal feces. The device is intended for use with bags and requires the use of a bag dispenser attached to the device's handle.

None of the above patents describes a sanitary waste handling device that can be operated with a single hand, uses ordinary plastic shopping bags to line the jaws, locks open so that bags may be affixed more easily, and includes bag clips to hold the bag in place during operation.

None of the above inventions and patents, taken either singly or in combination, is seen to describe the instant invention as claimed.

SUMMARY OF THE INVENTION

The animal waste scooper is a pole-mounted device for picking up waste and simultaneously placing the waste into a bag. The scooper includes a control assembly, an extension assembly, a support structure, a linkage assembly, a pair of jaws, and a bag. The control assembly comprises a handle, a trigger and a latch. The extension structure comprises a hollow pole having an upper end and a lower end, the handle being attached to the upper end of the pole. The support structure is an inverted bowl shape, with two extensions providing for linkage attachment, and is attached to the lower end of the pole. The support structure comprises a support bridge, a plurality of guide slots and a plurality of bag clips to secure a bag in place. The linkage assembly includes an actuation rod, a four-bar linkage including a double bell crank, a hinge pin, a pair of guide pins and a linkage shield. Each half of the double bell crank has its corner attached to the hinge pin, which serves as a fulcrum. The actuation rod is routed through the hollow pole and attaches to the trigger at one end and to the four-bar linkage at the other end. The hinge pin pivotally connects the jaws, and is fixed to opposing sides of the support bridge. The guide pins are disposed through the lower arm of each half of the double bell crank and the jaws, and engage the guide slots in the support bridge. A pair of springs is biased between the guide pins adjacent to the guide slots of the support bridge. The linkage shield is suspended from the hinge pin.

In use, the jaws are opened by pulling up the trigger and are latched by a hook connected between the trigger and a handle. An ordinary plastic shopping bag is opened, inverted, and placed over the jaws, the sides of the bag being retained over the jaws by retainer clips on the sides of the support bridge. The latch is released while holding the trigger to keep the jaws open, the jaws are positioned over the animal waste, and the trigger is released, closing the jaws to enclose the animal waste in the plastic bag.

Accordingly, it is a principal object of the invention to disclose an animal waste scooper which picks up animal waste and encloses the waste in common plastic shopping bags for disposal.

It is another object of the invention to provide an animal waste scooper having bag retention clips to securely hold an ordinary plastic shopping bag in place around the jaws of the scooper.

It is a further object of the invention to provide an animal waste scooper that may be operated with one hand.

Still another object of the invention is to disclose an animal waste scooper having jaws that may be latched open to simplify the bag-loading process.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is an animal waste scooper comprising a control assembly, an extension structure, a support structure, a linkage assembly, a pair of jaws, and a plurality of springs.

Figure 1:
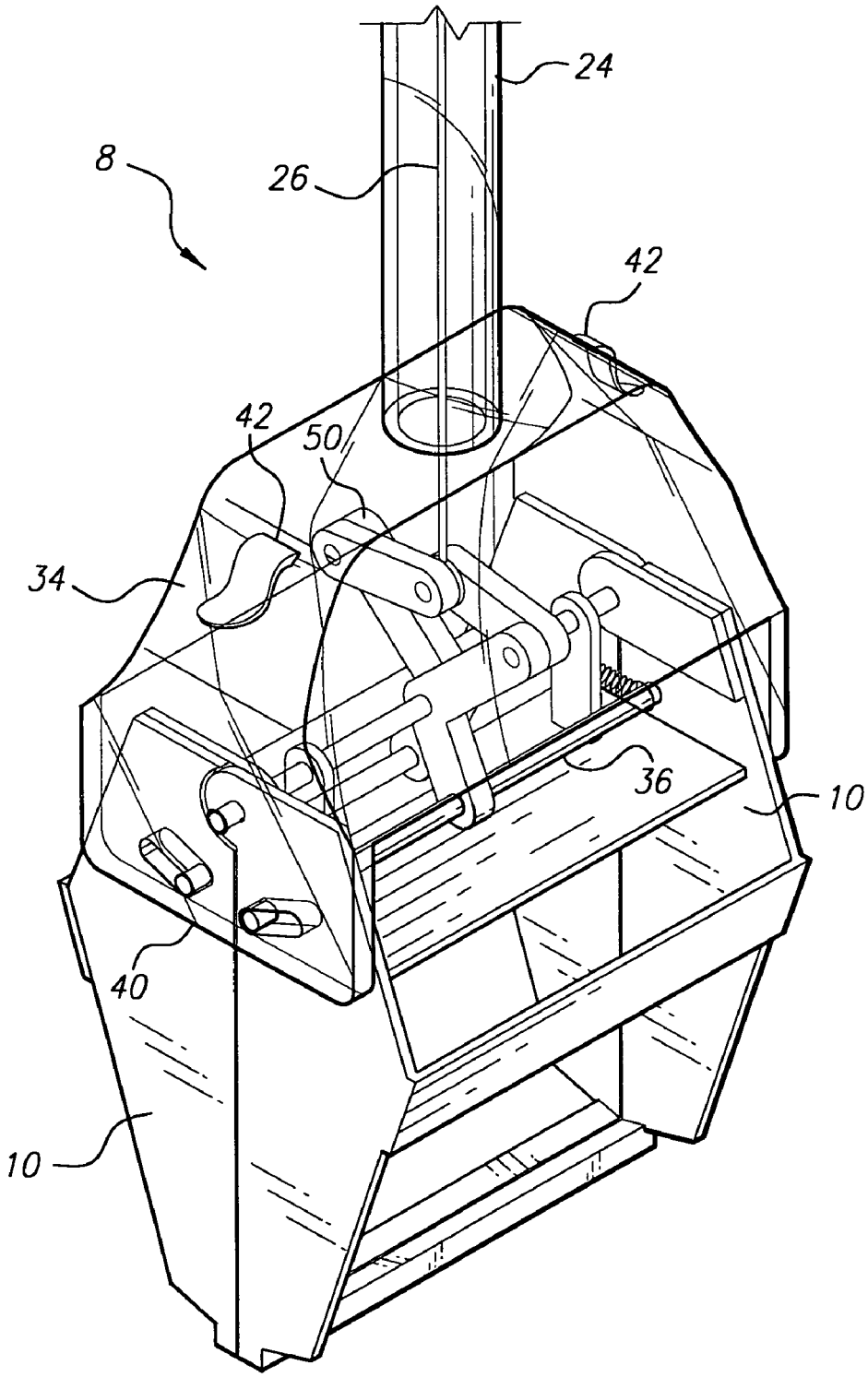
FIG. 1 is a fragmented perspective view of an animal waste scooper according to the present invention.
Figure 2:
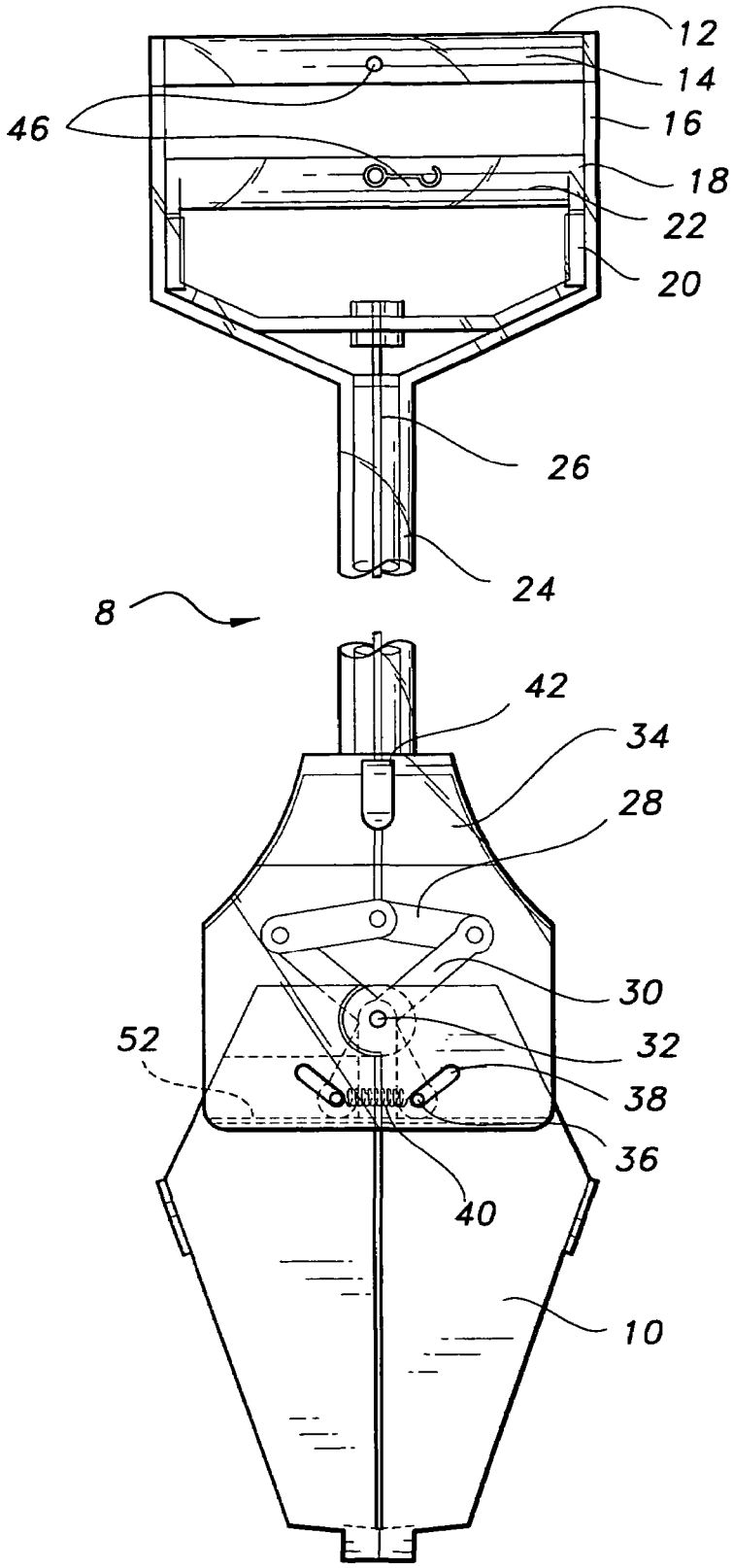
FIG. 2 is a side view of the animal waste scooper with the jaws closed according to the present invention.

Referring to FIGS. 1 and 2, the present invention is a generally vertically disposed animal waste scooper, designated generally as 8 in the drawings. The device 8 is held and operated with one hand, with the opposed scoop-shaped jaws 10 being placed over the object to be picked up. The scoop-shaped jaws have an upper containment portion and a lower grasping portion with opposing sidewalls. The user squeezes the trigger 18 to operate the linkage assembly 50 and open the jaws 10 against the biasing springs 40 (only one spring 40 is shown in the drawings, the opposite side of the scooper 8 being identical). The jaws 10 are supported by an inverted bowl-shaped support bridge 34, which in its preferred embodiment are made of a strong, lightweight, corrosion-resistant metallic or nonmetallic material, such as aluminum, vinyl, polycarbonate, fiberglass, or other synthetic polymeric material.

An ordinary plastic shopping bag is secured around the jaws with the bag clips 42. The jaws 10 are placed over and around the object on the ground and the trigger 18 is released. The springs 40 bias the jaws 10 to a closed position, capturing the object in the jaws 10 and returning the linkage assembly 50 and trigger 18 to their original positions. The object may be transported to another place, such as a waste receptacle, within the device's jaws 10. The object is released by removing the bag from the clips 42 and squeezing the trigger 18 to open the jaws 10. The bag and its contents drop out and away from the jaws 10. For ease of manufacture, each half of the jaws 10 is identical, Referring particularly to FIG. 2, the handle 12 of the scooper 8 comprises a grip portion 14 with a side rail 16 at each end. In the preferred embodiment, the handle 12 and the grip portion 14 are each half-round shape, with the flat side of the handle 12 oriented down and the flat side of the grip portion 14 oriented up, so that when the trigger is squeezed toward the handle 12 the flat sides are together. Each side rail 16 includes a guide rib (not shown). The channels are parallel and face toward each other. The trigger 18 is disposed in a generally D-shaped opening defined by the handle 12 and also has a grip 22 portion and two side rails 20. The trigger's side rails 20 contain slots to engage the side rails guide ribs. The trigger 18 slides upon the handle's side rail 20, guided by the engagement of the guide ribs and slots.

The handle 12 attaches to an upper end of a hollow pole extension structure 24. In the preferred embodiment, the pole 24 may also be made from a strong, lightweight, corrosion-resistant metallic or nonmetallic material, such as aluminum, vinyl, polycarbonate, fiberglass, or other synthetic, polymeric material. An actuator 26 is attached at one end to the trigger 18, and is routed through the hollow pole 24, where the other end of the actuator 26 attaches to a pin of a four-bar linkage mechanism 50. The actuator 26 may be a cable, a rod, or other elongated material capable of withstanding the tension created by the biasing springs 40. The linkage mechanism 50 includes a pair of upper links 28 pivotally connected to the actuator at one end, and pivotally attached to a pair of bell cranks 30 at the opposite end. Alternatively, the upper links 28 may be replaced by a single, flexible piece of material, such as a cable or monofilament line joined at its midpoint to the actuator 26.

Each bell crank 30 has an upper arm and a lower arm rigidly attached at approximately a 90° angle, defining a corner. Each upper link 28 is pivotally attached to the upper arm of one of the bell cranks 30, which form the lower links in the four-bar linkage 50. The corners of each bell crank 30 are pivotally attached to the hinge pin 32. The lower legs of each bell crank 30 are pivotally attached to guide rods 36, which are rigidly attached to the opposing jaws 10. The double bell crank 30 provides the leverage necessary to open the jaws 10, when the trigger 18 is squeezed.

When the trigger 18 is pulled upward, one bell crank 30 rotates about the hinge pin 32 in a clockwise direction, while the other bell crank 30 rotates in a counterclockwise direction, thereby opening the jaws 10. The hinge pin 32 also pivotally connects the jaws 10 and is rigidly positioned and supported by the support bridge 34. The guide rods 36 are fixed to the jaws 10, while the ends of the guide rods 36 extend through and slide within the guide slots 38 defined in the support bridge 34. The ends of guide pins 36 are biased together by a pair of compression springs 40. In the preferred embodiment, the compression springs 40 are located inside the walls of the support bridge 34. The support bridge 34 includes a pair of bag clips 42, one on each outward facing side, for securing ordinary plastic shopping bags. A linkage shield 52 provides a horizontal barrier within the jaws 10 and just below the guide pins 36. The linkage shield 52 is suspended by a pair of supports attached to the hinge pin 32. The supports extend between the guide pins 36, without interfering with the closure of the jaws 10. The linkage shield 52 prevents fingers and bags from becoming entangled in the linkage mechanism.

Figure 3:
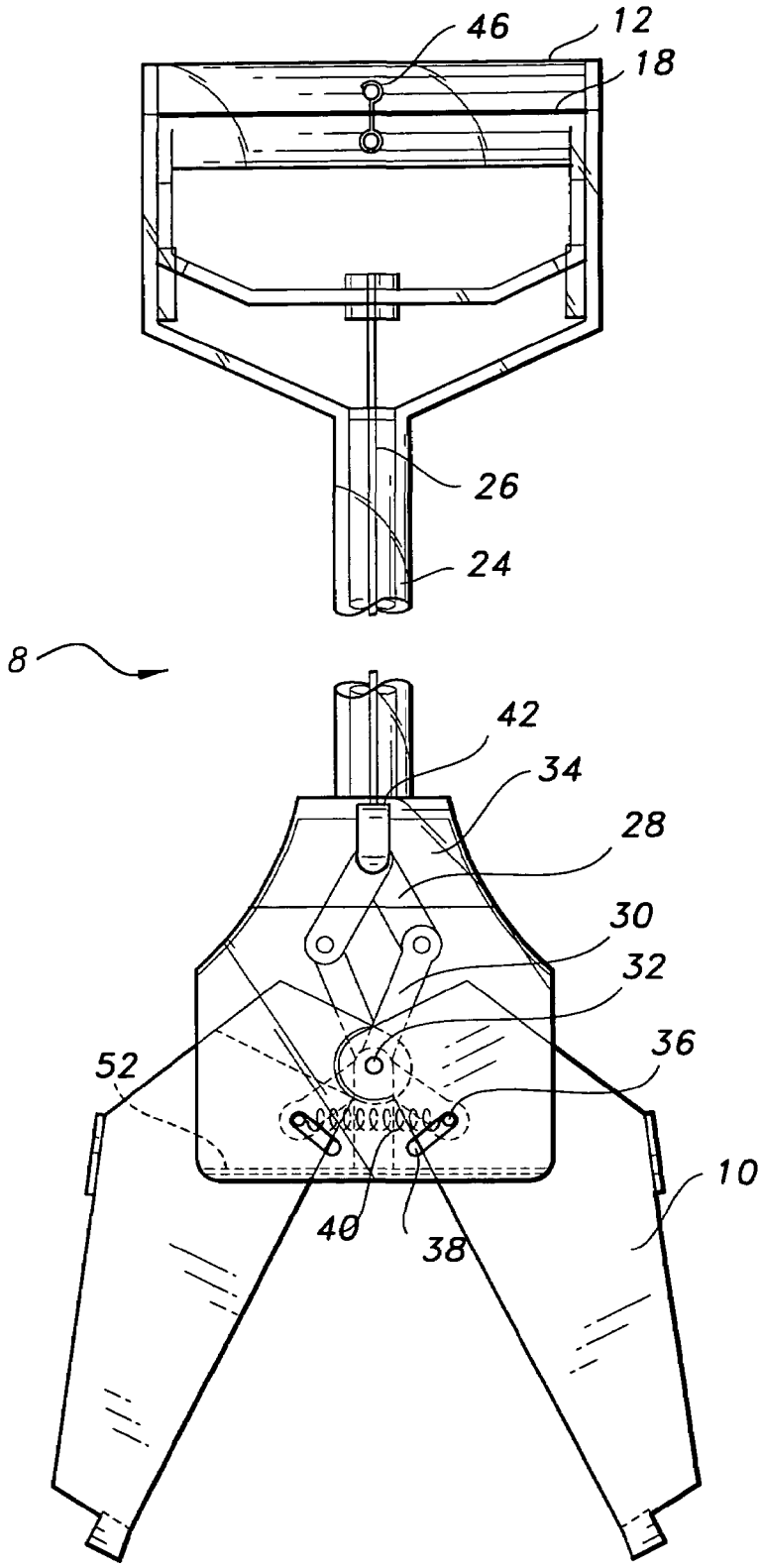
FIG. 3 is a side view of the animal waste scooper with the jaws open according to the present invention.

FIG. 3 is a side view of the animal waste scooper 8 according to the present invention with the jaws 10 open.

In operation, when the trigger 18 is squeezed toward the handle 12, the actuator 26 is pulled upward, pulling the pin joining the upper links 28 upward toward the handle 12. The linkage pulls the upper arms of the bell cranks 30 upward, drawing the upper arms of the double bell crank 30 together. The corners of the bell cranks 30 pivot on the hinge pin 32, forcing the lower arms of the bell crank 30 apart. The attachment of the lower arms of the double bell crank 30 to the jaws 10 forces the jaws 10 open against the biasing force of the springs 40 attached to the guide rods 36. A linkage shield 52 is suspended from the hinge pin 32 and between the guide pins 36 to provide a horizontal barrier to protect the linkage assembly.

When the trigger 18 is adjacent to the handle 12, the latch 46 may be set, thereby locking the trigger 18 to the handle 12 and locking the jaws 10 open. Latch 46 may be a hook pivotally attached to trigger 18 which engages a pin or eyelet extending from the handle 12, however any appropriate latch may be used in the present invention. With the jaws 10 locked open, the user may place an ordinary plastic shopping bag around the jaws 10 and secure it to the bag clips 42 without working against the mechanism, simplifying the process.

Figure 4:
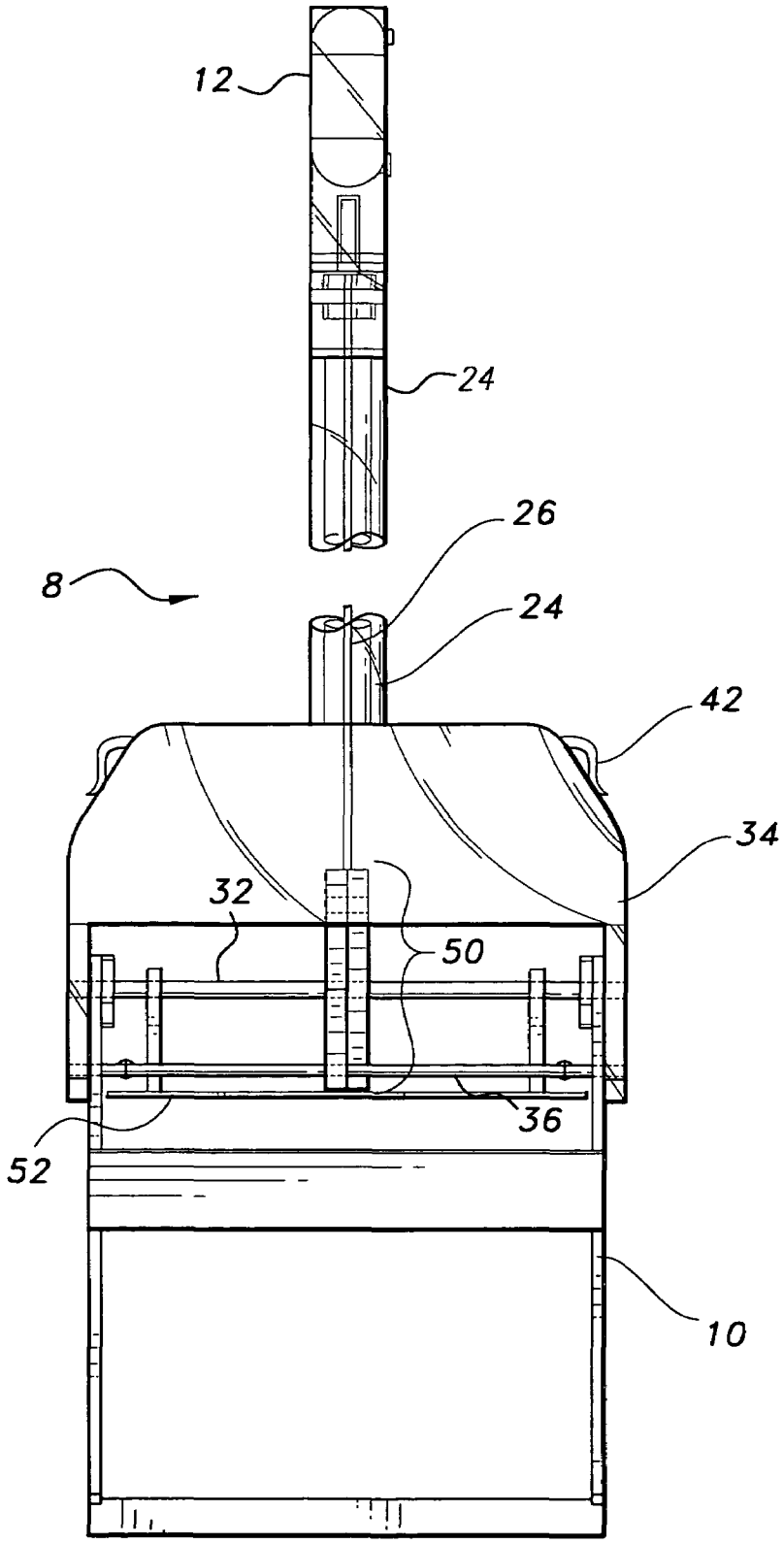
FIG. 4 is a front view of the animal waste scooper, the opposite side being a mirror image.

FIG. 4 is a front view of the animal waste scooper 8, the opposite side being a mirror image. The jaws 10 are skeletonized to reduce weight, presenting an open frame which discourages the use of the device without bags. This keeps the device clean and aids in its longevity. The linkage assembly 50 is located midway between the opposing sides of the support bridge 34 and in line with the longitudinal axis of the hollow pole 24 to enable proper function of the linkage assembly 50 through the actuator 26. The bags clips 42 are located at the sides of the support bridge 34.

Figure 5:
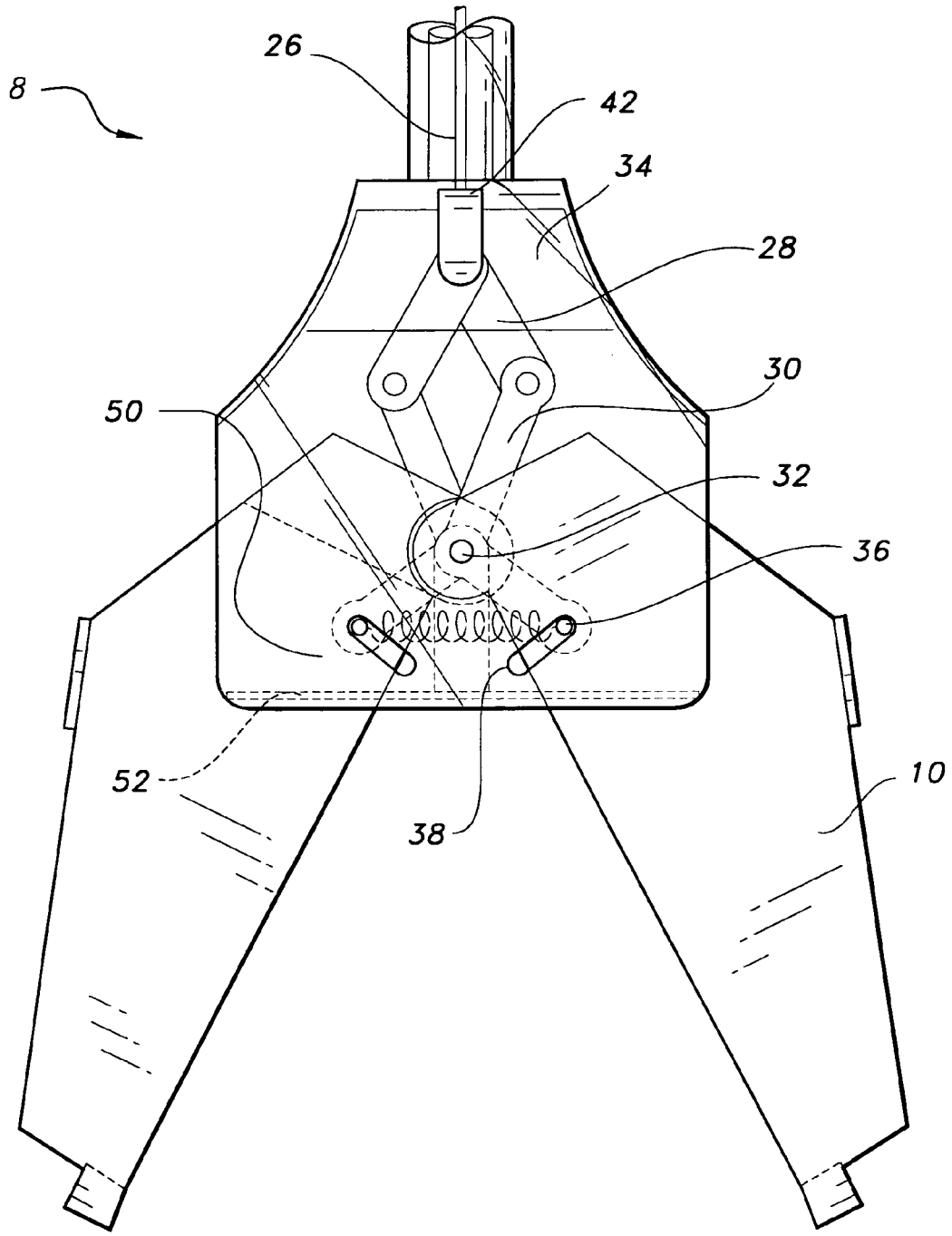
FIG. 5 is a fragmented side view showing the linkage and jaws of the animal waste scooper.

FIG. 5 is a side view showing the linkage assembly 50 and jaws 10 of the animal waste scooper 8. Here the actuator 26 is in tension, pulling the upper links 28 toward the handle 12. The upper links 28 pivot about the pin joining the upper links 28, thus drawing the opposite ends of the upper links 28 together. Alternatively, a one-piece flexible cable (not shown) may be used. As the ends of the upper links are drawn together, the bell cranks 30 are forced to rotate about the stationary hinge pin 32. The upper arms of the bell cranks 30 are drawn together, and the lower arms of the bell cranks 30 are forced apart due to rotation about the hinge pin 32. The lower arms of the double bell crank 30 are attached to the jaws 10 via the guide rods 36. The guide rods 36 engage the guide slots 38 in the support bridge 34. At their closest points, the guide slots 38 are close enough together to permit the jaws 10 to fully close. At their extreme ends, the guide slots 38 are far enough apart to permit the jaws 10 to accept a plastic bag and to be placed around an object to be picked up.

Figure 6:
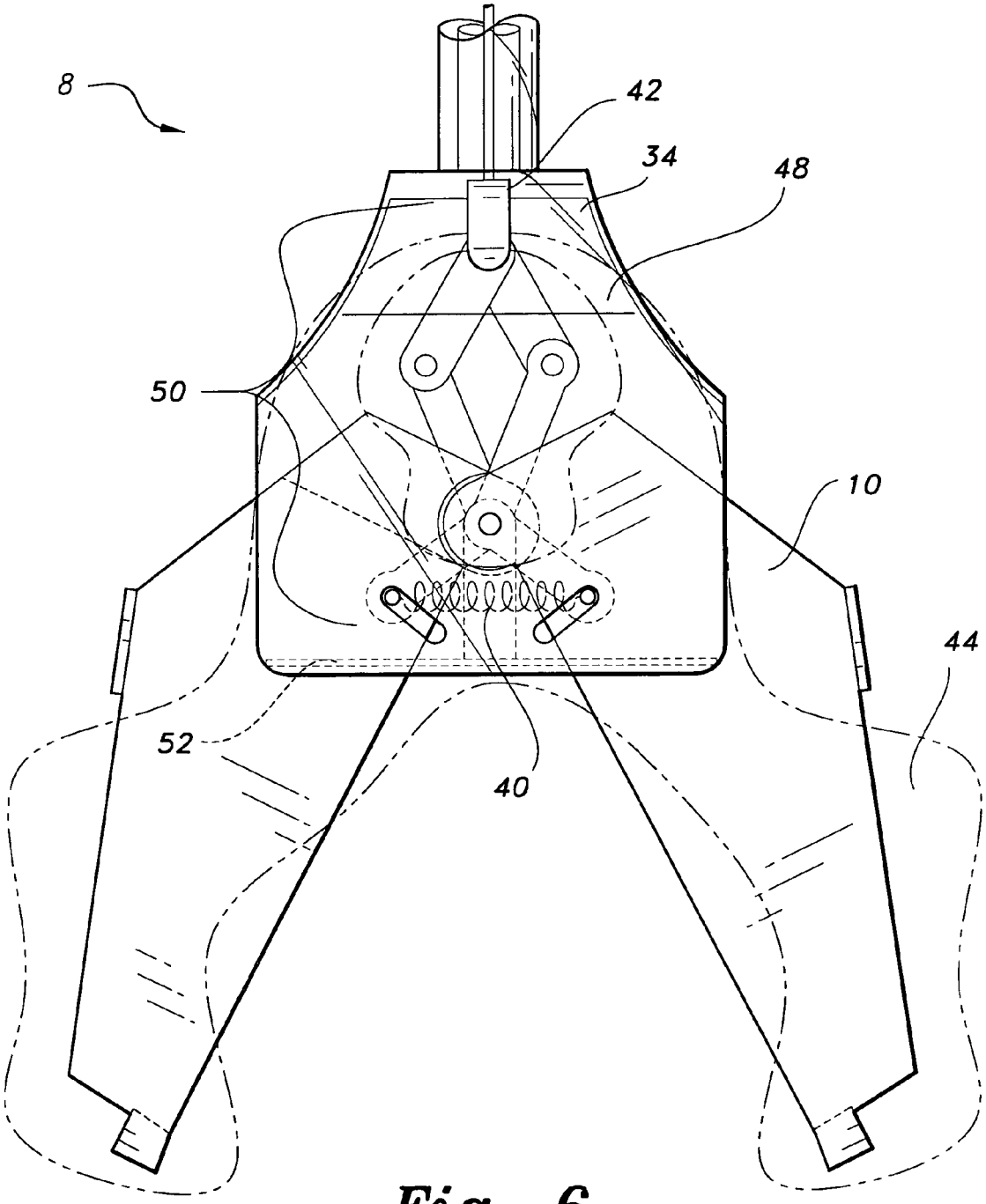
FIG. 6 is a fragmented side view showing the linkage and jaws of the animal waste scooper, with bag attached and shown in phantom.

FIG. 6 is a view of the linkage assembly 50 and jaws 10 of the animal waste scooper 8, with bag 44 (shown in phantom) attached. To secure a bag 44 around the jaws 10, the user must squeeze the trigger 18 to the handle 12 and operate the latch 46. This locks the jaws 10 open. With the jaws 10 open, the user places the jaws 10 into an inverted, open, conventional plastic shopping bag 44, with one of the bag's two loop handles 48 located on each side of the support bridge 34. Each handle loop 48 is secured into a bag clip 42 on the support bridge 34, and the remaining portion of the bag 44 is pushed up into the space between the jaws 10, thus covering the jaws 10 and allowing a space between the jaws 10 large enough to encompass the object desired for retrieval.

When the object is between the jaws 10, the latch 46 may be released. The springs 40 act to bias the jaws 10 to the closed position, whereby the object is captured between the jaws 10 and inside the bag 44. In this manner, the jaws 10 stay clean.

It is to be understood that the present invention is not limited to the embodiments described above, but encompasses any and all embodiments within the scope of the following claims.

I claim:

1. A hand-operated animal waste scooper, comprising:

a control assembly an extension structure attached to said control assembly;

a support structure having a plurality of bag clips, said support structure depending from said extension structure, and having an upper cross portion and a depending side portion from each end thereof, at least one of said plurality of clips being mounted on each depending side thereof;

a linkage assembly connected through said extension structure to said control assembly;

a pair of generally scoop-shaped opposed jaws attached to said linkage assembly, each of said jaws having an upper containment portion, a lower grasping portion, and opposed sidewalls; and a plurality of springs attached to said linkage assembly and between said jaws;

said control assembly comprising:

a handle;

a trigger attached between said linkage assembly and said handle;

said trigger being operable between an unpulled state wherein said linkage assembly is in an inactivated position and said jaws are in a closed position and a pulled state against spring pressure from said plurality of springs wherein said linkage assembly is in an activated position and said jaws are in an open position;

a latch attached between said handle and said trigger;

said latch being movable between an unsecured position when said trigger is in an unpulled state and a secured position when said trigger is in a pulled state, thereby holding said trigger against said spring pressure;

said linkage assembly comprising:

upper linking means;

an actuator extending between said trigger and said linking means;

a hinge pin extending between said depending side portions of said support structure; and a pair of opposed bell cranks, each said bell crank having an upper arm and a lower arm having respective free ends and rigidly attached at about a right angle forming a corner thereof, each said corner being pivotally mounted on said hinge pin, said upper arm extending upwardly from said hinge pin, said lower arm extending outwardly from said hinge pin;

said upper linking means being attached to and extending between respective said free ends of said bell crank upper arm;

said upper linking means being attached at its central portion to said actuator;

a pair of guide rods extending between respective said opposing sidewalls of said opposed jaws, each said lower arm being pivotally connected at about its free end with a central portion of said corresponding guide rod, at least one of said plurality of springs being connected between said guide rods;

whereby, upon the pulling of said trigger, said actuator pulls the central portion of said linking means upward relative to said hinge pin, thereby pulling said free ends of said upper arms of said bell cranks inward toward one another as they rotate on said hinge pin, said free ends of said lower arms of said bell cranks rotating outward, thus moving said guide rods outward against the pull of said at least one spring and thereby opening said opposed jaws attached thereto; and whereby, upon releasing of said trigger, said at least one spring pulls said guide rods together, thereby closing said opposed jaws;

whereby upon activation of said control assembly, said linkage assembly acts upon said pair of jaws, opening said jaws and upon installing an inverted plastic bag over said jaws and said support structure and secured to said bag clips, said pair of jaws covered by the plastic bag may be lowered over the animal waste, and upon deactivation of said control assembly, the bag supported by said jaws may be closed around the animal waste by action of said springs on said linkage assembly between said jaws, encasing the animal waste with said plastic bag and upon said bag being removed from said bag clips and pulled downward reverting the bag to its normal disposition, upon activation of said control assembly, said jaws may be opened, allowing said reversed bag containing the animal waste to be removed from the jaws of said animal waste scooper and disposed of without the hands of the operator or any part of the waste scooper from touching the animal waste.

2. The hand-operated animal waste scooper of claim 1, wherein said extension structure comprises a hollow pole extending between said handle and said support structure.

3. The hand-operated animal waste scooper of claim 1, wherein said sidewalls of said opposed jaws overlap and said jaws are pivotally attached at the upper ends of their respective sidewalls to said hinge pin.

4. The hand-operated animal waste scooper of claim 1, wherein said depending sides of said support structure having guide slots receiving the opposing ends of said guide rods, said guide slots being dimensioned and oriented so as to guide and limit the travel of guide rods through their inward and outward movement corresponding to the closing and opening of said opposed jaws.

5. The hand-operated animal waste scooper of claim 1, further comprising a linkage shield having a horizontal plate suspended from spaced hangers, said spaced hangers being mounted on said hinge pin between said scoop opposed sidewalls, said linkage shield forming a horizontal barrier to avoid said bag or its contents from entering said linkage.

6. The hand-operated animal waste scooper of claim 1, said upper linking means comprising a pair of upper links pivotally connected at said actuator at a common end and pivotally attached at their opposed ends to said upper free ends of said opposed bell cranks, respectively;

whereby, upon pulling of said trigger and said attached actuator, said upper links extend upward at their central common ends, thus pulling said free ends of said bell cranks inward toward each other and thereby opening said opposed jaws.

7. The hand-operated animal waste scooper of claim 1, wherein said springs are mounted between said guide rods at points adjacent the inner side of said scoop sidewalls.

8. The hand-operated animal waste scooper of claim 1, in said handle having an upper horizontal grip and opposed side rails at each end thereof, having a vertical portion extending vertically downward and an angled portion extending inward, forming a generally D-shaped opening, said side rails joining at said extension structure at its upper end, said vertically extending portion of said side rails each having an inner facing guide rib extending therein.

9. The hand-operated animal waste scooper of claim 8, wherein said trigger is generally D-shaped and fits within the lower portion of said handle D-shaped opening, said trigger having a horizontal grip and opposed side rails at each end thereof, having a vertical portion extending vertically downward and an angled portion extending inward, said side rails joining at the upper end of said actuator and connected thereto, said vertical side rail portions having slots therein slidingly engaging said side rails and guide rib of said handle.

10. The hand-operated animal waste scooper of claim 9, wherein said handle grip is of a half-round shape with the flat side oriented downward, and said trigger grip is of a half-round shape with the flat side oriented upward and disposed such that, upon pulling said trigger grip upward, the mutual flat sides of said handle grip and said trigger grip come together.

11. The hand-operated animal waste scooper of claim 10, wherein said latch comprises a hook installed on said trigger grip and an eyelet installed on said handle grip so located that said hook can engage said eyelet when said trigger grip is pulled against said handle grip.

12. The hand-operated animal waste scooper of claim 1, wherein said lower grasping portions of said opposed jaws are formed by open frames.

* * * * *